United States Patent [19]

Sugiura et al.

[11] Patent Number: 4,858,794

[45] Date of Patent: Aug. 22, 1989

[54] SUBMERGED NOZZLE FOR STEEL CASTING

[75] Inventors: Sadanobu Sugiura, Anjo; Kunishige Tokunaga; Teruhisa Kawashima, both of Kariya, all of Japan

[73] Assignee: Toshiba Ceramics Co., Ltd., Tokyo, Japan

[21] Appl. No.: 199,789

[22] Filed: May 27, 1988

[30] Foreign Application Priority Data

Jun. 5, 1987 [JP] Japan ..... 62-139670

[51] Int. Cl.[4] ..... B22D 35/00

[52] U.S. Cl. ..... 222/606; 164/437; 266/236

[58] Field of Search ..... 266/236, 265, 266, 220; 222/603, 606, 607; 164/437

[56] References Cited

U.S. PATENT DOCUMENTS 3,931,850 1/1976 Landgraf et al. ..... 164/437
4,671,433 6/1987 Podrini et al. ..... 222/606
4,691,844 9/1987 Ishino et al. ..... 164/437

FOREIGN PATENT DOCUMENTS 3623660 1/1988 Fed. Rep. of Germany ..... 164/437
135464 6/1986 Japan ..... 164/437
226149 10/1986 Japan ..... 164/437

*Primary Examiner*—Robert McDowell
*Attorney, Agent, or Firm*—Foley & Lardner, Schwartz, Jeffery, Schwaab, Mack, Blumenthal & Evans

[57] ABSTRACT

A nozzle which is submerged in molten metal during steel casting comprises a nozzle body, a nozzle passage provided through the nozzle body such that a molten-metal-and-gas stream can be introduced into the nozzle body at a predetermined point, and at least one discharge port, wherein the discharge port is bordered by a projecting part that presents a surface that is inclined toward the introduction point for the metal/gas stream at a slanting angle, relative to the longitudinal axis of the nozzle body, that is greater than 0°. The nozzle has a substantially prolonged service life.

11 Claims, 3 Drawing Sheets

SUBMERGED NOZZLE FOR STEEL CASTING

BACKGROUND OF THE INVENTION

This invention relates to a nozzle which, in its typical use, is submerged in molten metal during steel casting and which is used in guiding molten metal from a tundish to a mold, especially in a continuous steel casting apparatus.

In a conventional steel casting apparatus which uses a submerged nozzle, argon gas is blown into molten metal which is moving down through the submerged nozzle. The gas is introduced through the nozzle in order to avoid the deposition of unwanted steel onto an inner nozzle surface, resulting in a blockage.

The argon gas moves, along with the molten metal flow, into and out of the submerged nozzle, and then floats to the surface of a molten metal in a mold where a mold powder layer exists. When this happens, the gas moves from molten steel, which has a higher specific gravity, to a mold powder layer having a lower specific gravity. At the boundary surface, therefore, the volume of the argon gas suddenly expands and the gas bubbles burst.

This bursting, accompanied by the drastic change in gas volume, agitates the mold powder layer so that the molten metal damages a part of the nozzle ("nozzle powder line section") that is in contact with the mold powder layer.

In a steel casting apparatus which incorporates a submerged nozzle, the demand for multiple continuous casting and enhanced service life has recently increased, reflecting a need to obtain operating advantages and to reduce production cost.

In general, since wear of the nozzle powder line section presents a most critical problem in terms of service life, a $ZrO_2$-C material displaying excellent anti-corrosion properties has been used for the powder line section of submerged nozzles.

In an attempt further to improve the wear-resistance of the powder line section of such nozzles, the thickness of the powder line section was increased, in hopes of prolonging the service life of the powder line section as compared with a prior-art nozzle which has a straight (non-slanted) powder line section. But the rate of damage, which can be expressed as a thickness of a damaged portion worn off per unit time, did not substantially change. Thus, as occurred with the straight powder line section-type of submerged nozzle, the gas bubbles moved up directly from the discharge port and floated near the nozzle, making it possible to attain only a relatively slight, advantageous effect attributable directly to the increase in thickness.

Japanese Utility (Laid-Open) Model No. 59-89648 discloses a submerged nozzle provided with a projecting part having a slanting surface which makes an obtuse angle (D) with the longitudinal axis of the nozzle body, in a direction opposite that of the discharge port, bordering an end portion of the discharge port (see present FIG. 4). The submerged nozzle is provided between a tundish or ladle (not shown) and a mold 9. With reference to the submerged nozzle as it is normally used (see FIG. 4), a lower end portion of the submerged nozzle 1 is immersed in a molten steel 10 in the mold 9. A nozzle passage 1*a* is formed in the nozzle 1 and connected with two or more discharge ports 2 so as to guide a molten metal into the mold 9 in the direction designated by the arrows. A projecting part 4' is formed at an upper end of each discharge port 2 for guiding both the molten metal 5 and the argon gas bubble 3. The projecting part 4' has a slanting surface with a dipping angle to a horizontal line, so that the slanting surface is inclined downwardly. The slanting surface of the projecting part 4' and a slanting surface of the discharge ports constitute a common surface which is inclined downwardly, relative to the direction of fluid flow within the nozzle.

The arrangement shown in FIG. 4 has proved effective, however, only in keeping gas bubbles far from the powder line section, i.e., the gas bubbles ejected from the discharge ports still collide directly against the slanting surface of the projecting part. As a result, damage to the projecting part becomes a more serious problem, to the extent that a reduction in the service life of the projecting part occurs.

Accordingly, in case of the submerged nozzle having a increased thickness at the powder line section, the powder line section must be further improved because it is subject to greater damage in comparison with the other nozzle sections. On the other hand, when a submerged nozzle has a projecting part with a slanting surface that borders an upper end of a discharge port, the projecting part faces the gas bubble flow substantially at a right angle, which produces unavoidable phenomena such as damage by the molten metal to the projecting part. In addition, the flow of gas bubbles is changed into turbulent flow after the collision of the gas bubbles against the projecting part of the nozzle, thereby causing an increase in the agitation effects.

SUMMARY OF THE INVENTION

It is therefore an object of this invention to provide a submerged nozzle for use in steel casting in which damage by molten steel can be reduced so as to prolong service life.

It is also an object of this invention to provide a nozzle permitting easy control of gas bubbles, to the extent that the bubbles are caused to float at positions sufficiently distant from a powder line section of the nozzle.

In accomplishing the foregoing objects, there has been provided, in accordance with one aspect of the present invention, a submerged nozzle which is submerged in molten metal during steel casting and which comprises a nozzle body, a nozzle passage provided through the nozzle body such that a molten metal and gas stream can be introduced into the nozzle body at a predetermined point, and at least one discharge port, wherein the discharge port is bordered by a projecting part that presents a surface (4*a*) that is upwardly inclined away from the nozzle body at a slanting angle (C), relative to the longitudinal axis of the nozzle body, that is greater than 0°. In a preferred embodiment, the submerged nozzle has a powder line section comprised of $ZrO_2$-C and a plurality of discharge ports, at least one of which is formed in a side wall of the nozzle body so as to face outwardly.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

By way of example and to make the description more clear, reference is made to the accompanying drawings in which.

DETAILED DESCRIPTION OF THE PREFERRED EMBODIMENTS

The present invention makes it possible to prolong substantially the service life of a submerged nozzle without increasing the thickness of the power line section of the nozzle.

Generally, damage from molten steel is produced by (1) the diffusion of low melting point-based compound within the steel caused by chemical reaction against the alkali compounds (CaO, MgO, $Na_2O$, $K_2O$, $CaF_2$); and (2) the desorption of $ZrO_2$ particles resulting from the oxidation consumption of resin coke and graphite of the material ($ZrO_2$) comprising the powder line section in the nozzle. The factors responsible for modulating and accelerating the rate of damage by molten metal to the powder line section mainly include: (a) the agitation of molten metal within the mold (electromagnetic agitation and mold oscillation); and (b) the agitation (air vibration) produced by the expansion when the argon gas to be injected in the molten metal floats on the surface of the molten metal within the mold.

The present invention can control the direction of the molten metal flow and, in addition, isolate the powder line section of the submerged nozzle from the expanding and foaming argon gas, thereby reducing the influence of the agitation alluded to in item (b) above.

A submerged nozzle for use in a continuous steel casting apparatus is thus provided vertically, according to the present invention, between a tundish or ladle (not shown) and a mold 9. A discharge portion side of the submerged nozzle 1 is immersed in a molten metal 10 in the mold 9. A nozzle passage 1*a* is formed in the nozzle 1 and connected with two or more discharge ports 2 so as to guide molten steel into the mold 9 in the direction designated by the arrows in FIG. 2.

Figure 2:
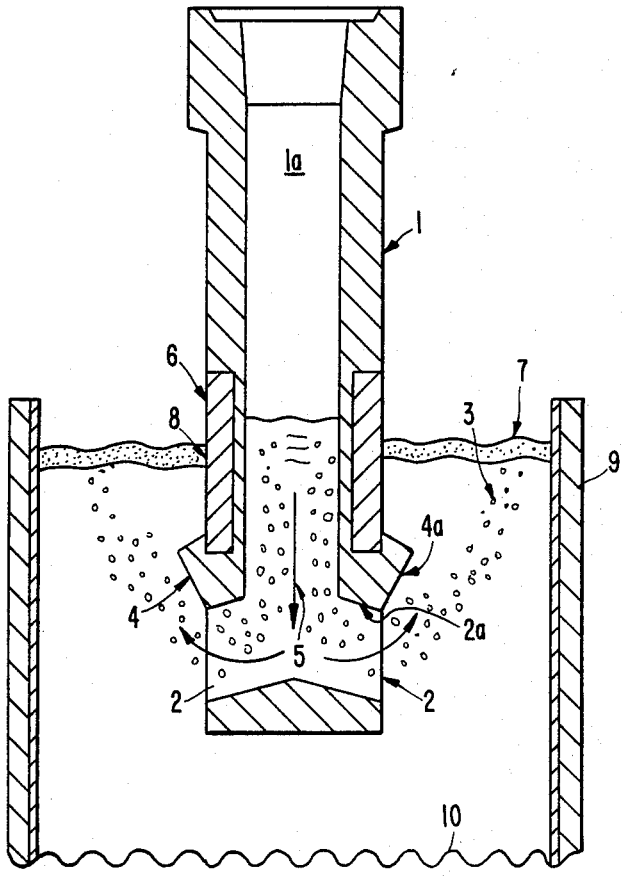
FIG. 2 is a cross sectional view showing a submerged nozzle and its related members according to this invention.

As shown in FIG. 2, a projecting part 4 is formed around the nozzle 1 at the upper end of each discharge port 2 for guiding smoothly both the molten metal 5 and the argon gas bubbles 3. The projecting part 4 has a tapered, slanting surface 4*a* which has an angle of elevation to the horizontal which is such that the slanting surface is inclined upwardly and outwardly from the nozzle body, i.e., The gas bubbles 3 move up along the slanting surface 4*a* in the direction of the arrows from the discharge ports 2.

The projecting part 4 functions to adjust the direction of the gas bubble flow 3 and the molten metal flow 5. Argon gas bubbles 3 float along with the molten steel 5 at a location far from the powder line section 6 of the submerged nozzle 1. Therefore, it becomes possible to reduce the agitation effects accompanied by the volume expansion and bursting during the float of the gas bubble 3 at the powder layer 7 and avoid the damage of a portion 8 of the powder line section 6 which contacts powder layer 7.

Preferably, the projecting part has a thickness (A), ranging between about 5 mm and 50 mm, which is defined as the distance from an outer surface of nozzle 1 to an outer, top portion of the projecting part 4 (see FIG. 1), and a slanting angle (C), ranging from about 30° to about 85° in a clockwise direction, between the longitudinal axis of the nozzle body and the slanting surface 4*a* of the projecting part. It is also preferred that the projecting part have a height (B) of between about 10 mm and 200 mm, where height B is the vertical distance from the (upper) end of the discharge port 2 that is nearest to the projecting part to the end of the outer top portion of the projecting part 4 that is farthest from the discharge port.

A preferred slanting surface in this regard is a tapered surface. The projecting part may be integral with or separate from the nozzle body.

Pursuant to the present invention, foaming and bursting phenomena can be effectively avoided, so that the gas bubbles float on the surface of the molten steel 10 in the mold 9 smoothly. Furthermore, according to this invention, the gas bubbles 3 bound at the projecting part 4 so as to scatter, thereby avoiding the generation of turbulent flow. This advantage is particularly pronounced relative to the projecting part 4' of the prior-art submerged nozzle shown in FIG. 4, where the slanting surface of the projecting part 4' has a dip angle to an imaginary horizontal line.

Figure 4:
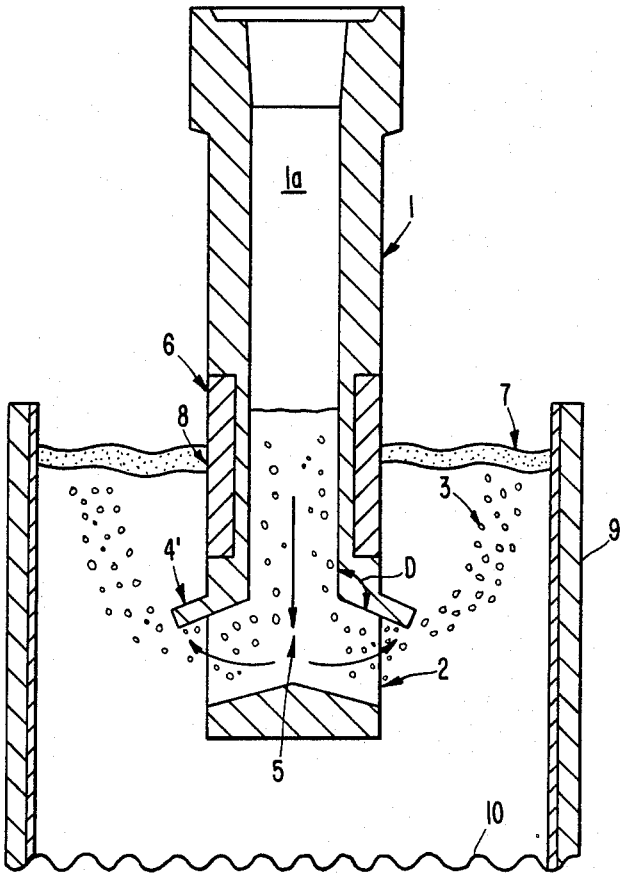
FIG. 4. (PRIOR ART)
FIG. 4 is a cross sectional view showing a prior-art submerged nozzle and its related members.

In addition, the present invention makes it possible to reduce the damage of the projecting part 4 and, hence, prolong the service life of the submerged nozzle 1 because gas bubbles 3 move along the slanting surface 4*a* of the projecting part 4. In contrast, the prior-art projecting part 4'illustrated in FIG. 4 is directly subject to the pressures of the gas bubbles 3 and the molten steel flow 5.

Preferably, each of the discharge ports 2 have a slanting surface 2*a* which is inclined downwardly in a dip direction and connected to a lower end of the slanting surface 4*a* of the projecting part 4. An angel formed between the slanting surface 2*a* of the discharge ports 2 and the slanting surface 4*a* of the projecting part 4 is about 90°.

Figure 1:
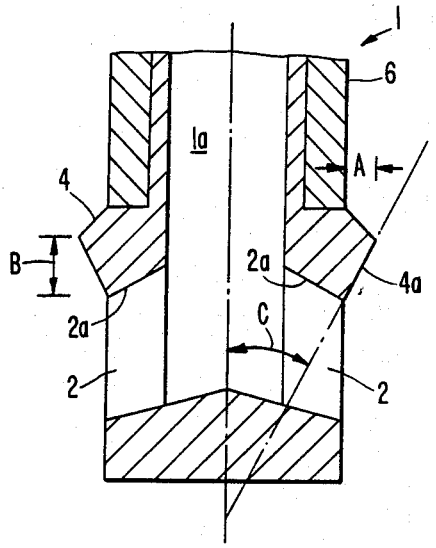
FIG. 1 is a cross sectional view showing a projecting part of a submerged nozzle and its related portions according to this invention.
Figure 3:
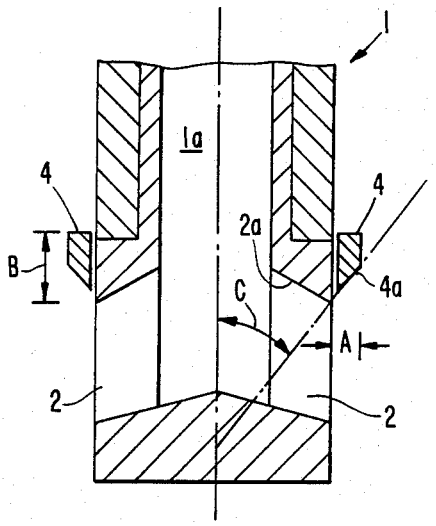
FIG. 3 is a cross sectional view showing a projecting part of a submerged nozzle and its related portions according to this invention.

In the embodiment FIGS. 1 and 2, although the projecting part 4 is integral with the body of nozzle 1, a ring-shaped projecting part 4 which is separate from the nozzle body can be attached to a straight-type nozzle at an upper end of the discharge ports 2, as shown in FIG. 3. So that the argon-gas bubbles can float at a sufficiently distant location from the nozzle powder line section 6, the projecting part 4 has a thickness A ranging between about 5 and 50 mm, a height B ranging between about 10 and 200 mm and a slanting angle C ranging between about 30° and 85°. As illustrated in FIG. 3, thickness A is measured from the outer surface of the nozzle 1 to the top surface of the projecting part 4; height B is measured from the upper end of the discharge port 2 to the upper end of the top surface of the projecting part 4; and slanting angle C is the angle between the longitudinal axis of the nozzle and the slanting surface of the projecting part, in the clockwise direction.

In the embodiment shown in FIG. 3, since ring-shaped projecting part 4 can be replaced by another one, it is easy to change the slanting angle C, the height B and the thickness A in such a way that the functions of the projecting part can meet the service requirements. Although not shown, the ring-shaped projecting part can be fixed to the nozzle body by means of screws, mortar, pins, or the like.

A submerged nozzle having a projecting part according to this invention has a service life several times longer than prior-art nozzles because it is capable of discharging argon gas into the mold smoothly and allowing the gas to float at a location distant from the mold powder section of the nozzle, thereby preventing the gas from generating turbulence. A submerged nozzle within the present invention may also have a powder line section of increased thickness, so as further to prolong service life.

What is claimed is;

1. A nozzle which is submersible into molten metal during steel casting, comprising:

(a) a nozzle body having a lower end portion for submersion into molten metal and an upper end portion, (b) a nozzle passage provided through said nozzle body such that a molten metal and gas stream can be introduced into said nozzle body at said upper end portion, and (c) at least one downwardly-directed discharge port which is inclined downwardly away from said lower end portion, wherein said discharge port (i) is bordered at the upper portion thereof by a part projecting from said nozzle body that presents a surface upwardly inclined away from the longitudinal axis of said nozzle body and (ii) lacks downwardly directed surfaces against which gas bubbles exiting through said discharge port would collide.

2. A nozzle according to claim 1, wherein said nozzle body comprises a powder line section comprises of $ZrO_2$—C.

3. A nozzle according to claim 1, wherein said discharge port is formed in a side wall of the nozzle body so as to face outwardly, relative to said nozzle passage.

4. A nozzle according to claim 1, wherein the projecting part has a height (B) ranging from about 10 mm to about 200 mm, wherein height (B) is the distance along the longitudinal axis of said nozzle body measured from the end of a discharge port which is nearest the projecting part to the end of an outer top portion of the projecting part which is farthest from the discharge port.

5. A nozzle according to claim 1, wherein the slanting surface is a tapered surface.

6. A nozzle according to claim 1, wherein the projecting part is integral with the nozzle body.

7. A nozzle according to claim 1, wherein the projecting part is a ring-shaped projecting part separate from the nozzle body and wherein the projecting part is fixed to the nozzle body.

8. A nozzle according to claim 1, wherein an angle formed between the slanting surface of the discharge port and the slanting surface of the projecting part is about 90°.

9. A nozzle submersible into molten metal during steel casing, comprising:

(a) a nozzle body having a lower end portion for submersion into molten metal and an upper end portion;

(b) a nozzle passage provided through said nozzle body such that a molten metal and gas stream can be introduced into said nozzle body at said upper end portion;

(c) a plurality if discharge ports at said lower end portion, wherein at least one discharge port of said plurality presents a slanting surface that is downwardly directed away from said lower end portion so as to direct said molten metal and gas stream downwardly and away from said nozzle body; and (d) a projecting part on the outer surface of the nozzle body bordering the upper portion of said discharge ports, said projecting port presenting a slanting surface that is upwardly inclined outwardly at an angle of between 30° to 85° from the longitudinal axis of said nozzle body, and having a thickness of about 5 mm to 50 mm measured from the outer surface of the nozzle body to the outer portion of the projecting part.

10. A nozzle according to claim 9, wherein said projecting part is tapered.

11. A nozzle according to claim 9, wherein the angle formed between said slanting surface of the discharge port and said slanting surface of the projecting part is about 90°.

* * * * *